United States Patent [19]

Briner et al.

[11] Patent Number: 4,629,972

[45] Date of Patent: Dec. 16, 1986

[54] TEMPERATURE INSENSITIVE REFERENCE VOLTAGE CIRCUIT

[75] Inventors: Michael S. Briner, San Jose; Paul I. Suciu, Saratoga, both of Calif.

[73] Assignee: Advanced Micro Devices, Inc., Sunnyvale, Calif.

[21] Appl. No.: 700,360

[22] Filed: Feb. 11, 1985

[51] Int. Cl.[4] ..... G05F 3/20

[52] U.S. Cl. ..... 323/314; 323/354; 323/907; 365/104

[58] Field of Search ..... 323/313, 314, 315, 316, 323/353, 354, 907; 307/296 R, 297, 304; 365/94, 96, 103, 104

[56] References Cited

U.S. PATENT DOCUMENTS 4,071,813 1/1978 Dobkin ..... 323/313 X 4,087,758 5/1978 Hareyama ..... 323/314

4,100,437 7/1978 Hoff, Jr. ..... 323/314 X 4,189,671 2/1980 Yuen ..... 323/314

4,374,430 2/1983 Higuchi ..... 365/104

*Primary Examiner*—Peter S. Wong

*Attorney, Agent, or Firm*—Eugene H. Valet; Patrick T. King

[57] ABSTRACT

In an electronic circuit having a reference voltage generator, a device is provided to stabilize the reference voltage against operating temperature variations. Temperature insensitivity is achieved by interposing a source follower type circuit, having a fuse programmable variable resistance feedback loop, between the generator and the circuitry using the reference voltage level. The present invention is particularly suitable for integrated circuits which employs a single reference potential generating circuit device.

15 Claims, 6 Drawing Figures

(IMPLMENTATION OF A PRIOR ART VARIABLE RISISTANCE CIRCUIT)

(PRIOR ART - EXEMPLARY ADDRESS REGISTER CIRCUIT)

(PRIOR ART EXEMPLARY ADDRESS DECODER CIRCUIT)

TEMPERATURE INSENSITIVE REFERENCE VOLTAGE CIRCUIT

FIELD OF THE INVENTION

The present invention generally relates to reference voltage circuits, and more particularly to a circuit for providing a reference voltage level which is insensitive to operating temperature variations, especially suitable for single power supply system applications.

BACKGROUND OF THE INVENTION

In integrated circuit technology, the general function of a voltage generator or regulator is to provide a reference potential for use by individual or combinations of circuit components. For many applications, a regulated voltage source for providing a stable reference voltage level is an essential element. However, it is well known that circuit devices, particularly semiconductor components, have operating characteristics which are dependent upon both inherent physico-chemical aspects of the materials used in the construction of the devices and operating conditions under which they are required to perform their designed functions.

Metal-oxide semiconductor field effect transistors (MOSFET) are a natural choice for digital applications because of their ON, OFF method of operation. The mode at any particular point in time is controlled by a threshold voltage; i.e., the minimum applied gate-to-source voltage required to electrically invert the semiconductor layer under an insulated gate region, creating a conduction channel or, more simplistically, turning the MOSFET ON. The threshold voltage characteristic of any particular MOSFET is affected by both said commonly known, inherent characteristics and by the operating temperature which affects both these characteristics and the effective mobility of the carriers within the semiconductor materials of the device.

There is an important need, therefore, for reference voltage generators which exhibit long-term stability and insensitivity to fluctuations in the device's operating temperature and threshold voltage changes. For example, a key element to achieving a good endurance electrically erasable programmable read only memory (EEPROM) integrated circuit at an acceptable yield is a temperature insensitive voltage reference source, which controls the WRITE voltages.

A depletion mode MOSFET has an additional ion implantation directly into the channel region; said implant removes the requirement for a threshold voltage since these devices will have a channel and will conduct a current with a gatesource voltage of zero volts. Hence, a separate gate bias potential supply is eliminated.

A technique of combining depletion transistors with intrinsic transistors in an attempt to overcome these problems was proposed by R. A. Blauschild et al: *New NMOS Temperature-Stable Voltage Reference,* IEEE 2. A Solid-State Circuits, Vol. SC-13, No. 6, Dec. 1978, pp. 767–774. A stable voltage reference was obtained by a circuit generating a voltage proportional to the difference between enhancement mode transistor and depletion mode transistor threshold voltages. Basically, as temperature increases, both type transistor thresholds decrease with a similar slope of 2.3 mV/degree centigrade. This circuit is shown in FIG. 1 (prior art). However, the nature of the circuit makes implementation best suited for double power supply applications. Additionally, this complex technique requires a relatively large geometry section of the integrated circuit into which it is incorporated.

SUMMARY OF THE INVENTION

It is a principal object of the present invention to provide a temperature insensitive reference voltage level for integrated circuits.

It is another object of the present invention to provide an NMOS, temperature insensitive reference voltage circuit having a reduced device geometry suitable for integrated circuit design.

It is a further object of the present invention to provide a circuit for producing a temperature insensitive reference voltage level which, once trimmed to provide the desired potential, is not a function of the threshold voltage of the transistors in said circuit.

Yet a further object of the present invention is to provide a temperature insensitive reference voltage source follower type circuit, particularly suited for single power supply integrated circuit applications.

In its broad aspect, the present invention provides a device for providing an operating temperature insensitive reference voltage for circuits which use a reference potential supplied by a voltage generator or voltage regulator. A source follower stage of the device is coupled to the reference voltage generator. The output of the follower stage is fed back through a programmable variable resistance stage and current mirror stage. An output buffer stage is coupled to said source follower stage and current mirror stage. Once trimmed, the reference voltage level repeated at the output is essentially insensitive to operating temperature variations in said circuit.

Other objects, features and advantages of the present invention will become apparent upon consideration of the following detailed description and the accompanying drawings, in which like reference designations represent like features throughout the figures.

DETAILED DESCRIPTION OF THE INVENTION

Reference is now made in detail to a specific embodiment of the present invention, which illustrates the best mode presently contemplated by the inventors for practicing the invention, the preferred embodiment of which is set forth in the accompanying drawings. The drawings referred to in this description are to be understood as not drawn to scale and to illustrate only one portion of an integrated circuit fabricated in accordance with the present invention.

Figure 1:
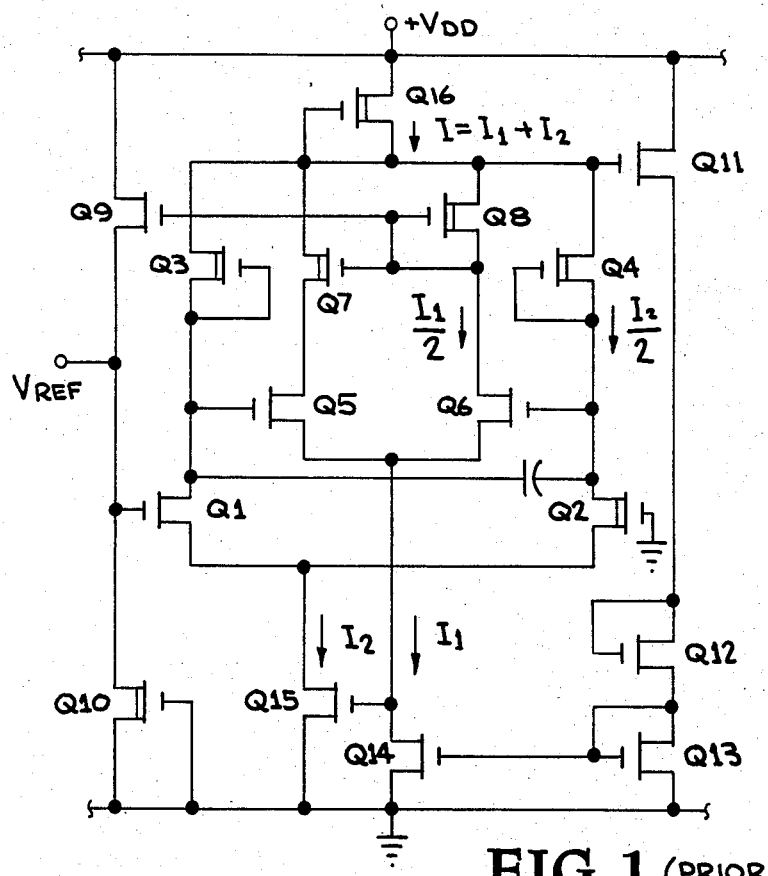
FIG. 1 (PRIOR ART)
FIG. 1 is an electrical schematic diagram of a device known in the prior art.
Figure 2:
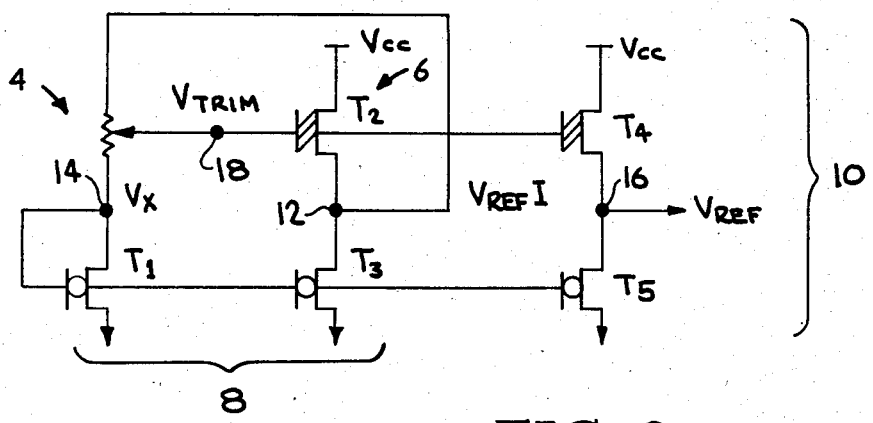
FIG. 2 is an electrical schematic diagram of the present invention.

FIG. 2 shows the circuit 2 of the present invention. A source follower stage 4 has an NMOS depletion mode transistor T2 which acts, in effect, as a load to a single power supply (not shown) which generates a voltage level Vcc to be used by an integrated circuit device as a reference potential. It is a function of T2 to attenuate variations in Vcc; that is, T2 effectively prevents Vrefi from being dependent upon Vcc. Vcc is coupled to the drain electrode of T2.

Figure 3:
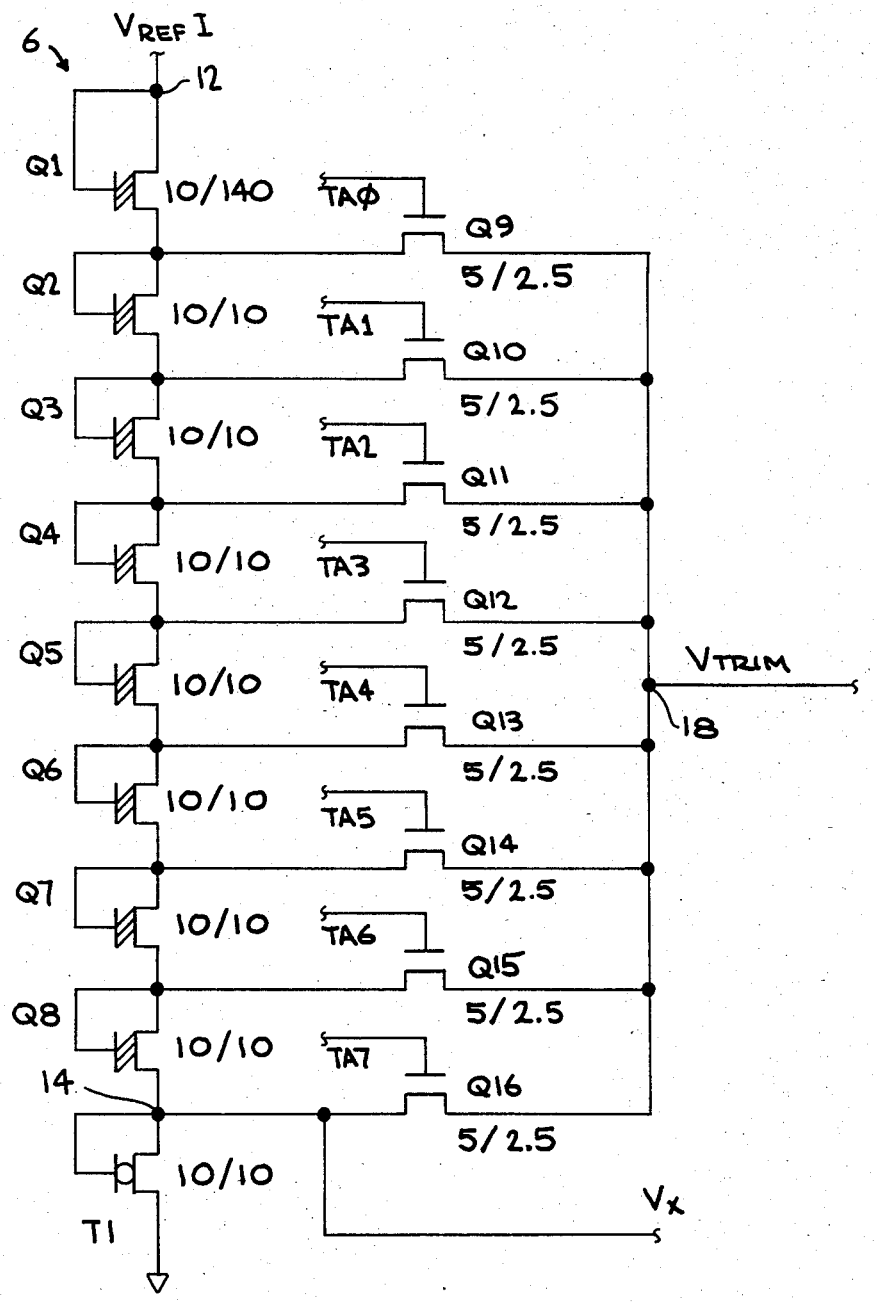
FIG. 3 is an electrical schematic diagram of a variable resistance circuit as used in conjunction with the present invention as shown in FIG. 2.

Referring briefly to FIG. 3, the variable resistance stage 6 feedback loop is demonstrated. This is a technique known in the art. See, for example, V. K. Dham et al, *A 5V-Only EPROM Using* 1.5 μ *Lithography*, IEEE International Solid-State Circuits Conference, Digest of Technical Papers, p. 166 et seq. (February 1983).

Figure 4:
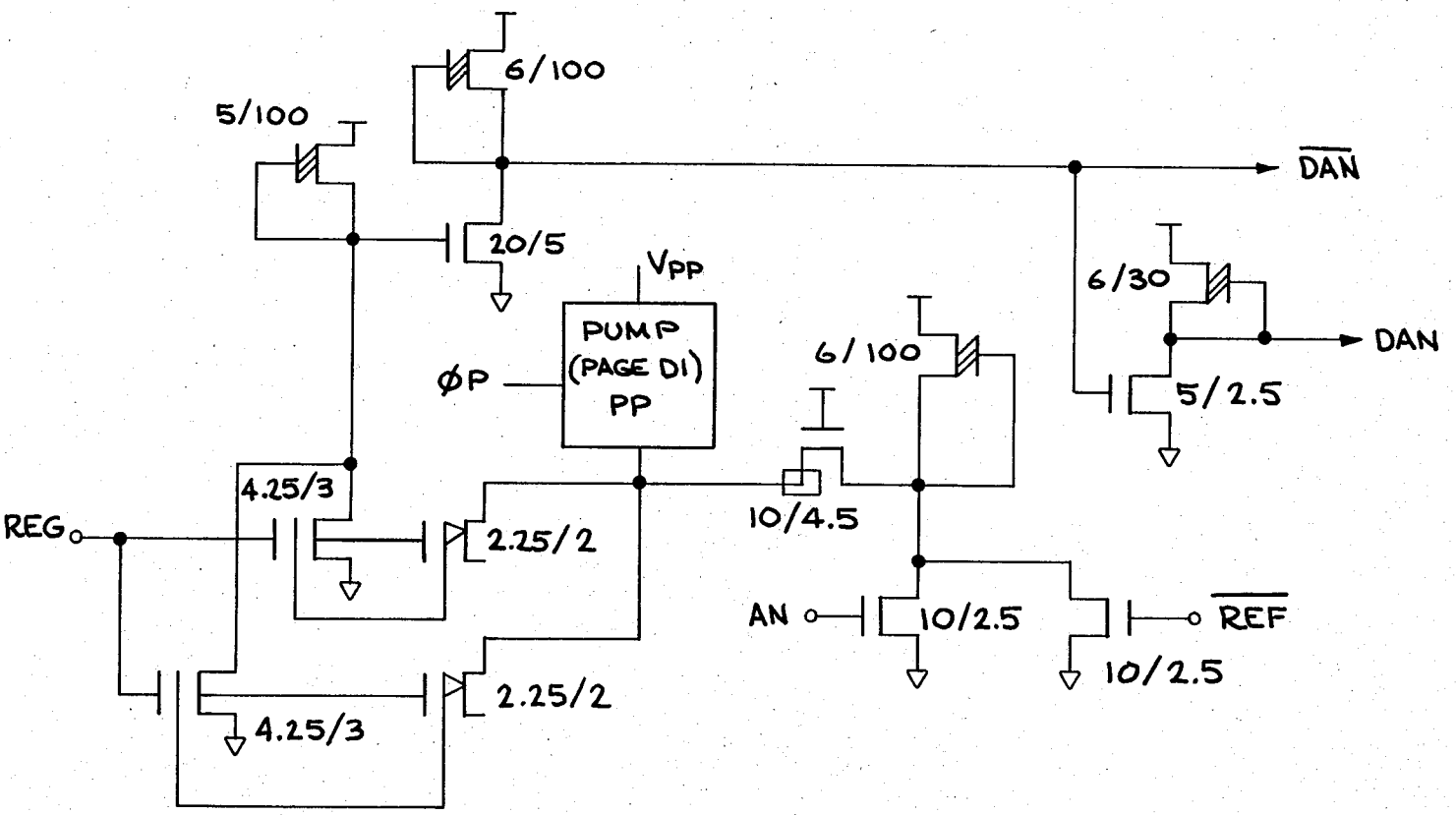
FIG. 4 is an electrical schematic diagram of a commonly known, exemplary address register circuit as used in "programming" the circuit as shown in FIG. 2.
Figure 5:
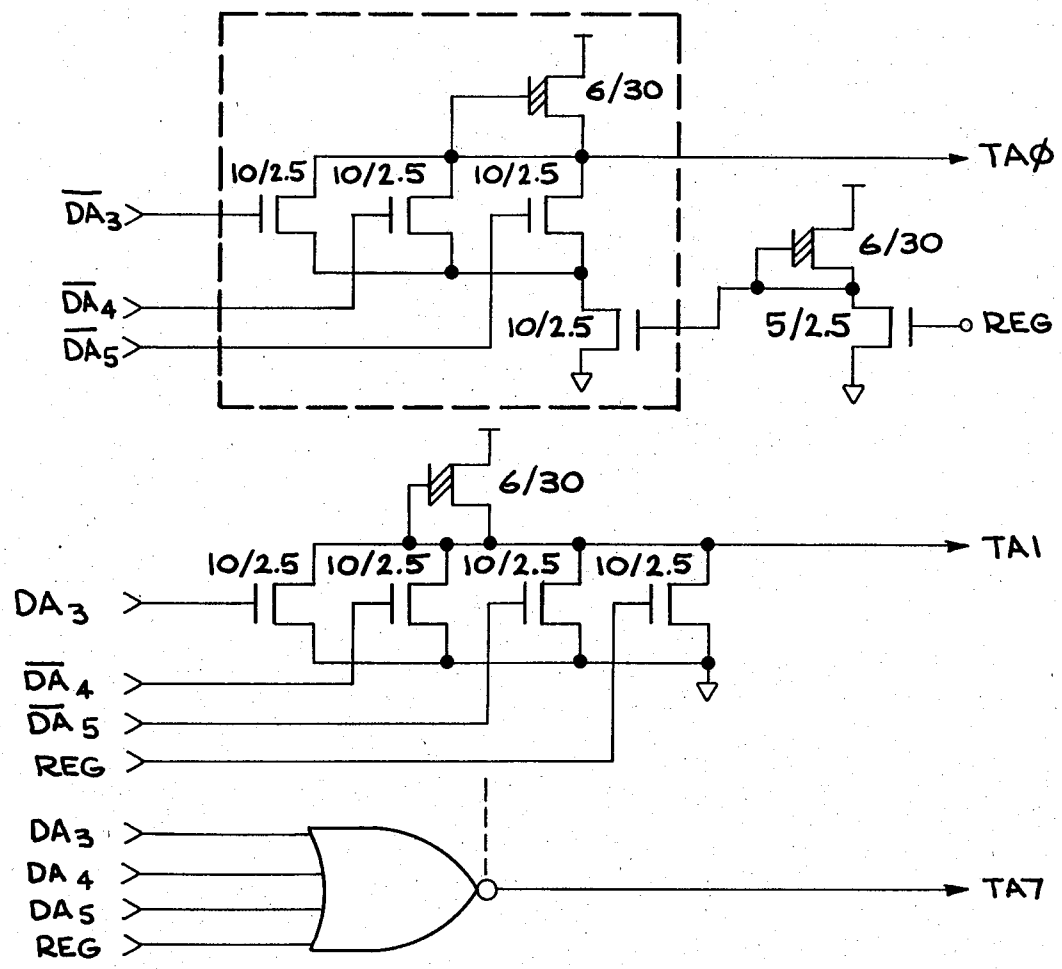
FIG. 5 is an electrical schematic diagram of a commonly known, exemplary address decoder circuit as used in conjunction with the address register circuit as shown in FIG. 4.

Basically, the series connected NMOS transistors Q1 through Q8 are used to present a programmable variable resistance stage 6 in the feedback loop to the source follower stage 4 of the device 2. An EEPROM Address Register and an Address Decoder, as commercially available in integrated circuit part Am2864A, manufactured by Advanced Micro Devices, Sunnyvale, Calif., are shown in FIGS. 4 and 5, respectively. Such exemplary circuits are used to selectively program the variable resistance stage 6 in the feedback loop of the source follower stage 4, whereby the final output voltage Vref, as shown in FIG. 2 at node 16 in output buffer stage 10, may be trimmed. Basically, as is known in the art, various techniques and circuit devices can perform the task of selecting appropriate levels of a variable resistance stage such that once trimmed, the present invention will then provide the stable Vref potential programmed.

Intrinsic NMOS transistor T1 of variable resistance stage 6 has its drain electrode coupled at node 14 to the source electrode of Q8, its source electrode coupled to the circuit's reference ground potential, and its gate electrode fed back to its drain electrode. A voltage drop is caused by Q1 through Q8 such that a stepped-down Vrefi, labeled as Vx, is produced at node 14, the drain electrode of T1.

T1 also forms the initial component of the current mirror stage 8. The current mirror has two parallel-connected NMOS intrinsic transistors, T1 and T3. An intrinsic NMOS transistor T3 is connected in series with T2. The source electrode of T2 is coupled to the drain electrode of T3 at node 12. The source electrode of T3 is tied to the integrated circuit's electrical ground reference. The gate electrode of T3 is coupled to the gate electrode of T1. T3 acts, in effect, as a driver of signal Vrefi at node 12 for the variable reference stage 6 feedback loop to the source follower stage 4.

The feedback loop thusly is completed through current mirror stage 8. Vrefi of the source follower stage 4 determines current flow in the mirror stage 8 via the feedback loop into the variable resistance stage 6 from node 12.

In addition to the electrical connections described above, T1 further has its gate electrode coupled to the gate electrode of T3. Hence, Vx appearing at node 14 provides a driving voltage for T3. T3 has its gate electrode also coupled to the gate electrode of T5.

T5, an NMOS intrinsic transistor connected in series with an NMOS depletion mode transistor T4, forms the output buffer stage 10 of the device 2. T5 has its gate electrode connected to the gate electrode of T3 and its source electrode coupled to the circuit's electrical ground reference. T4 has its drain electrode coupled to Vcc. The gate electrode of T4 is coupled to the gate electrode of T2. The source electrode of T4 is coupled to the drain electrode of T5 at the device output node. If should also be noted that since T5 is connected in parallel to the current mirror stage 8, it will also mirror the current flow of T1.

In operation, the device 2 output, Vref, at node 16 will be stable despite operating temperature variations of the integrated circuit. The variable resistance stage 6 and transistors T1, T2 and T3 generate Vrefi, while T4 and T5 form the output buffer of Vref, the temperature insensitive reference potential.

In the variable resistance stage 6, NMOS depletion mode transistors Q1 through Q8 are biased into their linear operating region by NMOS transistors Q9 through Q16, respectively. The standard circuits of FIGS. 4 and 5 are used to program the variable resistance stage to achieve the desired Vtrim for the particular circuit device application. In this configuration, the operating characteristic of the variable resistance stage 6 is changed very little by any change in the depletion threshold voltage.

The reduction of the intrinsic threshold voltage of T1 at high operating temperatures pulls Vx and Vtrim down. The resulting increase in the current through T1 is translated through the current mirror stage 8; i.e., through T3. Being a depletion mode type transistor, T2 is always in saturation. T3 is biased in a Vcc insensitive configuration. The reduction of the depletion threshold voltage of T2 at the increased operating temperature compensates for the reduction in its gate voltage and the increase in T3 current. Hence, Vref remains relatively unchanged at node 16.

Figure 6:
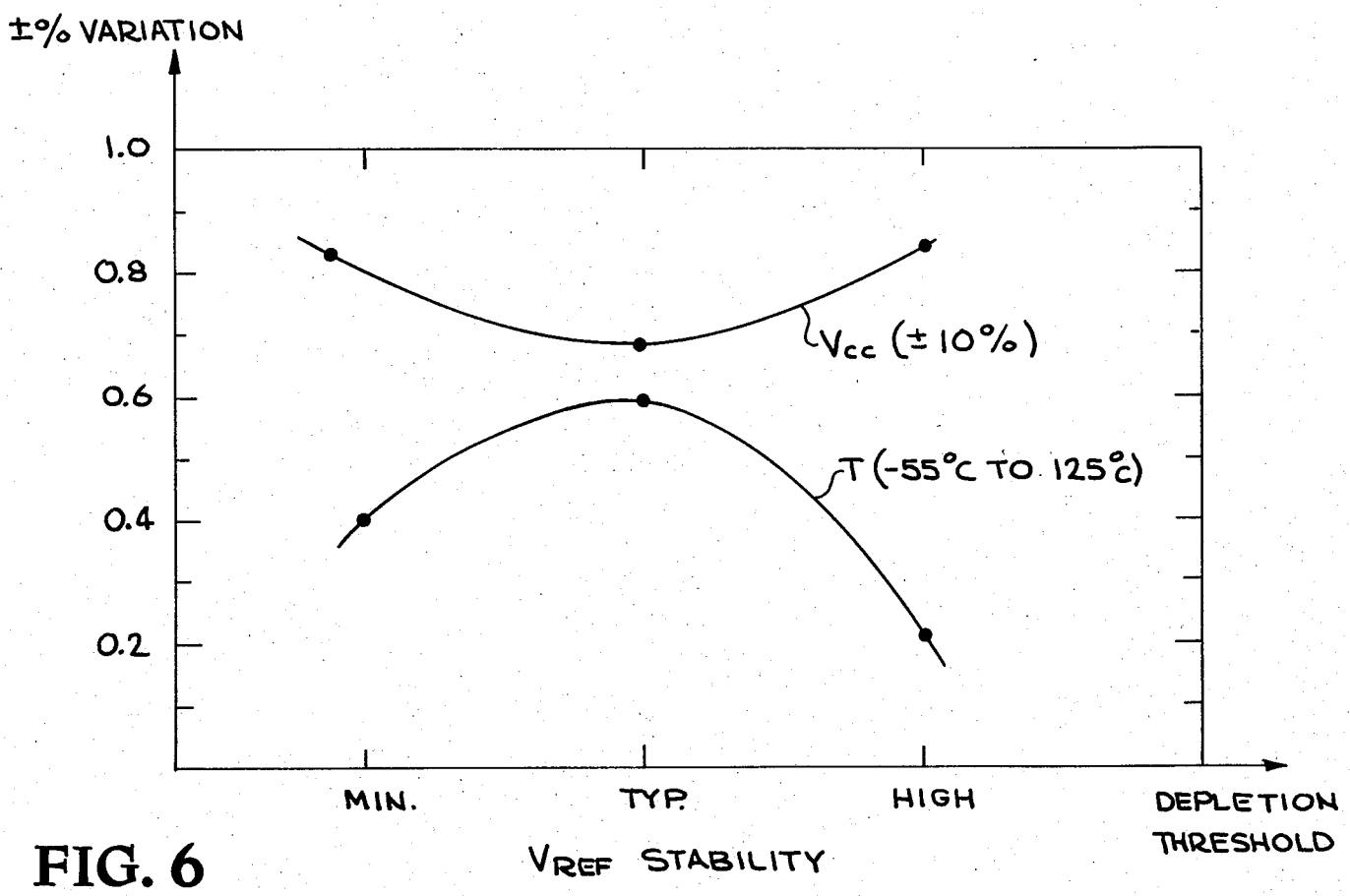
FIG. 6 is a graphical depiction of operating results obtained experimentally for the present invention, as shown in FIG. 2, over a temperature variation from −55 degrees to +125 degrees centigrade.

Experimentally obtained data is shown in the graph of FIG. 6, where Vcc is a positive 5 volt level. For example, in a typically processed silicon integrated test circuit (in this case, an EEPROM device) when the temperature varied from −55 degrees to +125 degrees centigrade, Vref decreased only 30 mV (Vrefi, Vtrim and Vy decreasd 20 mV, 96 mV, and 100 mV, respectively). The graph depicts two plots of the variation of Vref—one showing the variation with a ±10 percent fluctuation of Vcc, the other showing the variation with temperature versus the spectrum of threshold voltage levels which may occur in production.

Hence, FIG. 2 shows a novel voltage reference that, in addition to simplicity and, hence, compatibility with high component density, achieves a one percent stability across full military test specifications, viz., −55 to +125 degrees centigrade with a 10 percent power supply variation.

Aside, it should be noted that the carrier mobility variation factor has been ignored since, in NMOS transistor operation, the variation only has an effect on the current in a resistor-divider configuration and not the actual potential levels; hence, in the present invention, it does not affect Vx or Vrefi in the first order.

It will be recognized by one skilled in the art that the scaling factors in the transistors built into the integrated circuit will be dependent upon the nature of the device into which the present invention is incorporated.

The foregoing description of the preferred embodiment of the present invention has been presented for purposes of illustration and description. It is not intended to be exhaustive or to limit the invention to the precise form disclosed. Obviously many modifications and variations are possible in light of the above teaching. The invention can be practiced also in other technologies such as with bipolar, PMOS or CMOS fabrication. The embodiment was chosen and described in order to best explain the principles of the invention and its practical application, to thereby enable others skilled in the art to best understand the invention for various embodiments and with various modifications as are suited to the particular use contemplated. It is intended that the scope of the invention be defined by the claims appended hereto and their equivalents.

What is claimed is:

1. In a circuit having a means for generating a voltage level and an electrical ground reference, a device for providing an operating temperature insensitive reference potential comprising:

source follower means, coupled to said voltage generating means and having an output node, for attenuating variations in said voltage level;

feedback means, coupled to said source follower means, for biasing said source follower means; and current mirror means, coupled to said feedback means and said source follower means, for compensating temperature variation induced changes in operating characteristics of said source follower means, whereby said reference potential at said node is insensitive to operating temperature variations.

2. The device as set forth in claim 1, further comprising:

output means, coupled to said source follower means and said current mirror means, for buffering said reference potential.

3. The device as set forth in claim 2, wherein said device provides a stable reference voltage potential at said output buffer means across an operating temperature range of −55 to +125 degrees centigrade.

4. The device as set forth in claim 3, wherein said stable reference voltage potential varies less than ±1.0%.

5. The device as set forth in claim 1, wherein said source follower means comprises:

a first NMOS depletion mode transistor, having its drain electrode coupled to said reference voltage generator, its gate electrode coupled to said feedback means and to said output buffer means, and its source electrode coupled to said current mirror means.

6. The device as set forth in claim 5, wherein said current mirror means comprises:

a first NMOS intrinsic transistor, having its drain electrode coupled to said feedback means, its gate electrode coupled to said same drain electrode, and its source electrode coupled to said ground reference; and a second NMOS intrinsic transistor, having its drain electrode coupled to said source electrode of said first depletion mode transistor and to said feedback means, its gate electrode coupled to said gate electrode of said first intrinsic transistor, and its source electrode coupled to said ground reference.

7. The device as set forth in claim 6, wherein said output buffer means comprises:

a second NMOS depletion mode transistor, having its drain electrode coupled to said reference voltage generator, its gate electrode coupled to the gate electrode of said first depletion mode transistor, and its source electrode providing said operating temperature insensitive reference voltage level; and a third NMOS intrinsic transistor, having its drain electrode coupled to said source electrode of said second depletion mode transistor, its gate electrode coupled to said gate electrode of said second intrinsic transistor, and its source electrode coupled to said ground reference.

8. The device as set forth in claim 7, wherein said feedback means comprises:

a programmable variable resistance circuit means for trimming said reference voltage level repeated by said output buffer means.

9. The device as set forth in claim 8, wherein said resistance circuit means comprises;

a fuse programmable NOR decoder coupled in series with said first NMOS intrinsic mode transistor.

10. A temperature insensitive reference potential circuit for use in an integrated circuit device having a reference voltage generator and a programming means, comprising:

source follower means, coupled to said generator, for repeating said reference voltage;

programmable variable resistance means, coupled to said programming means and to said source follower means in a feedback arrangement, for providing a trimming bias potential to said source follower means;

current mirror means, coupled to said variable resistance means and said source follower means, for compensating operating temperature change induced variations in operating characteristics of said source follower means; and output buffer means, coupled to said source follower means and said current mirror means, for providing said temperature insensitive reference potential to said integrated circuit.

11. The circuit as set forth in claim 10, wherein said source follower means comprises a first NMOS depletion mode transistor.

12. The circuit as set forth in claim 10, wherein said current mirror means comprises two parallel connected NMOS intrinsic mode transistors.

13. The circuit as set forth in claim 12, wherein said output buffer means comprises a second NMOS depletion mode transistor coupled in parallel with said first depletion mode transistor and in series with a third intrinsic mode transistor.

14. In an electrically erasable programmable read only memory integrated circuit device having one reference voltage generator and an address register with an address decoder coupled thereto, a temperature insensitive reference potential circuit comprising:

a transistor, coupled to said generator;

a fuse programmable NOR decoder, coupled to said address decoder for programming and further coupled in a feedback loop configuration to said transistor;

a current mirror circuit stage, coupled to said NOR decoder and said transistor, providing compensation bias to said transistor in response to temperature change induced variations in operating characteristics of said transistor; and an output buffer circuit stage, coupled to said transistor and said current mirror stage, having an output node where said reference potential circuit provides a temperature insensitive reference voltage level for use by said device.

15. The circuit as set forth in claim 14, wherein said transistor is an NMOS depletion mode transistor.

* * * * *